United States Patent [19]

Burm et al.

[11] Patent Number: 4,905,542

[45] Date of Patent: Mar. 6, 1990

[54] LOCK-OUT TROLLEY FOR GARAGE DOOR OPENER

[75] Inventors: George C. Burm, Bloomingdale; Philip A. McCartney, Wheaton; Barry M. Bidinger, Schaumburg, James S. Chang, Arlington Heights, all of Ill.

[73] Assignee: The Chamberlain Group, Inc., Elmhurst, Ill.

[21] Appl. No.: 340,875

[22] Filed: Apr. 20, 1989

[51] Int. Cl.[4] ..... E05F 15/16; E05F 11/54; G05G 17/00

[52] U.S. Cl. ..... 74/625; 49/139; 49/360; 104/120; 160/188; 403/109

[58] Field of Search ..... 74/625; 49/139, 197, 49/199, 200, 360; 160/188, 189; 104/119, 120; 292/66, 67, 109, 110, 114; 403/109

[56] References Cited

U.S. PATENT DOCUMENTS

| | | | |
|---|---|---|---|
| 3,051,014 | 8/1962 | Houk | 74/424.8 |
| 3,066,729 | 12/1962 | Gessell | 49/139 X |
| 3,235,246 | 2/1966 | Cowan | 49/139 |
| 3,443,339 | 5/1969 | Goldstein | 49/141 |
| 3,591,981 | 7/1971 | Law | 49/139 |
| 3,630,094 | 12/1971 | Carli | 49/139 X |
| 3,722,141 | 3/1973 | Miller | 49/139 |
| 4,274,227 | 6/1981 | Toenjes | 49/28 |
| 4,597,428 | 7/1986 | Iha | 160/188 |

*Primary Examiner*—Allan D. Herrmann
*Attorney, Agent, or Firm*—Fitch, Even, Tabin & Flannery

[57] ABSTRACT

A lock-out trolley for a garage door has a first trolley member having body and a pair of pivot pins connected thereto. A latch arm, pivotally mounted on the pivot pins, has a trolley engaging member for selectively engaging a second trolley member. A cardioid shaped aperture in the latch arm engages one of the pivot pins and may lock the latch arm out of engagement with the second trolley member. A spring biases the latch toward its engaged position.

11 Claims, 3 Drawing Sheets

LOCK-OUT TROLLEY FOR GARAGE DOOR OPENER

BACKGROUND OF THE INVENTION

The invention relates to garage door openers. In particular, the invention relates to a releasable trolley for uncoupling and coupling a drive chain to a garage door.

It is well known that garage door opener systems provide safety and convenience for the driver and can be easily operated using a remote transmitting unit. Such a remote transmitting unit, which is typically carried in a vehicle, is used to signal the controller of the garage door opener system, to raise or lower the door, as the driver wishes. Garage door opener systems sometimes become inoperative either due to electrical power outage or, much more infrequently, due to mechanical malfunction. When a garage door opener system becomes electrically inoperative, the drive mechanism remains mechanically connected to the garage door, preventing it from being opened. A number of releasable connectors have been proposed for incorporation into the trolleys, which are reciprocated by the drive chain and connected to hardware attached to the garage door, for selectively disconnecting or mechanically uncoupling the garage door from the drive mechanism.

In U.S. Pat. No. 3,051,014 to Houk for Screw and Nut Mechanism, a garage door opener is disclosed having a carrier 28 which may be selectively connected and disconnected with a drive screw or a worm 26. A skew rack 51 selectively engages or is disengaged from the worm 26. Engagement is controlled by the position of a handle 58.

U.S. Pat. No. 3,443,339 to Goldstein for Release Mechanism For Garage Door Connecting Arm, assigned to the present assignee, discloses a garage door opener having an operating member 26, which may be pivoted by applying tension to a pull cord 27, causing confronting arm portions 28 to be separated from a coupling member pin 32 thereby disengaging the drive of the garage door opener from the door.

U.S. Pat. No. 3,722,141 to Miller for Overhead Door Operator Release teaches a garage door operator having a traveler 40 carried on a track 20. The traveler 40 is connected to be driven by a closed loop consisting of a driving chain 46 and a cable 48 interconnected by a turnbuckle 50. The traveler 40 also is connected to a sectional garage door to be controlled. The chain 46 and cable 48 are connected to the drive unit 22 to be driven thereby. The turnbuckle 50 is releasably retained in a traveler body 60 by a rectangular sliding plate latch 84. The latch 84 is connected to a trip cord 104 which normally holds the latch in connection with the turnbuckle 50 by means of a spring 90, however, the traveler 40 can be disconnected from the drive unit 22 by pulling downward on the trip cord 104.

U.S. Pat. No. 3,591,981 to Law for Door Operator discloses a garage door operator for a canopy type door. The garage door operator includes a manual release for permitting manual operation of the door by allowing a rack 52 to be disengaged from a driving pinion 51, as may best be seen in FIG. 6. This is achieved by pulling on a cord 81 and causing a lever arm 72 to rotate and pull the rack 52 out of engagement with the pinion 51.

U.S. Pat. No. 4,274,227 to Toenjes for Obstruction Sensor For Electro-mechanically Operated Garage Doors, which is assigned to the present assignee, discloses a garage door opener including a two-piece trolley having an outer trolley member 14 and an inner trolley member 16.

U.S. Pat. No. 4,597,428 to Iha for Two Drum Cable Drive Garage Door Opener, assigned to the present assignee, discloses a garage door opener having a trolley 51. A pawl 57 is slidably received in an opening in the trolley 51 which engages a notch 56 in the member 54 when the trolley 51 is locked to a cable 38. A spring 61 biases the pawl 57 into the notch 56. In order to release the door from the drive unit, a rope 62 connected to the pawl 57 is pulled downward by a handle 68 to draw the pawl out of engagement with the member 38.

It is also well known in the prior art to provide lock out mechanisms wherein a pawl of the type disclosed by Iha may be rotated slightly at the bottom of its travel and locked out of engagement with the cable or the drive unit. Unfortunately, until recently, separable trolleys of the type having an inner trolley which travels with the drive chain, an outer trolley which travels with the garage door, and a latch arm carried by the outer trolley which pivots about a pivot pin, have not had a lock-out feature. This lack of a lock-out feature prevented users of two-piece trolley garage door openers from locking the inner and outer trolleys in a disengaged state until such time as they are to be reengaged.

What is needed then is a two-piece trolley system with a latching arm and a lock-out feature.

SUMMARY OF THE INVENTION

The present invention of a garage door opener having a two-piece trolley with a lock-out feature provides a garage door opener which easily engages or disengages the garage door with a driving unit. Thus, in the event of a power outage or breakdown of the drive system, the garage door can be operated manually for an extended period without operating the latch mechanism on each cycle, because the trolley components are precluded from latching together each time they pass one another. One of the advantageous features of the instant invention is a latch arm which is almost totally enclosed within the outer trolley, thereby protecting the space between the two trolley halves from the entrance of dirt or unwanted material which could result in jamming of the latch arm or making its operation difficult.

Another advantage of the instant invention lies in the fact that since the latch arm is a lever with the point of application of force (for a lock-out slot) being positioned a shorter distance from the pivot than the spring biasing means, the latch arm comprises a class 2 lever which uses a relatively lightweight spring but which nevertheless provides adequate securing force.

The outer trolley and inner trolley assembly also may be easily reengaged by allowing the latch arm to return to its engaged position and bringing the two trolley halves together whereby the trolley engaging member of the latch arm is cammed along chamferred surfaces of the inner trolley until the latch arm is biased into engagement with the rectangular aperture of the inner trolley.

It is a principal aspect of the present invention to provide a garage door opener having a separable trolley with a lock-out latch arm.

It is another aspect of the present invention to provide a garage door opener having a two-piece trolley with a latch arm which is substantially shielded by an outer trolley body which carries it.

Other aspects of the present invention will become apparent to one of ordinary skill in the art upon a perusal of the specification and claims in light of the accompanying drawings.

BRIEF DESCRIPTION OF THE DRAWINGS

Corresponding reference characters indicate corresponding components throughout the several views of the drawings.

DETAILED DESCRIPTION OF THE PREFERRED EMBODIMENT

Figure 1:
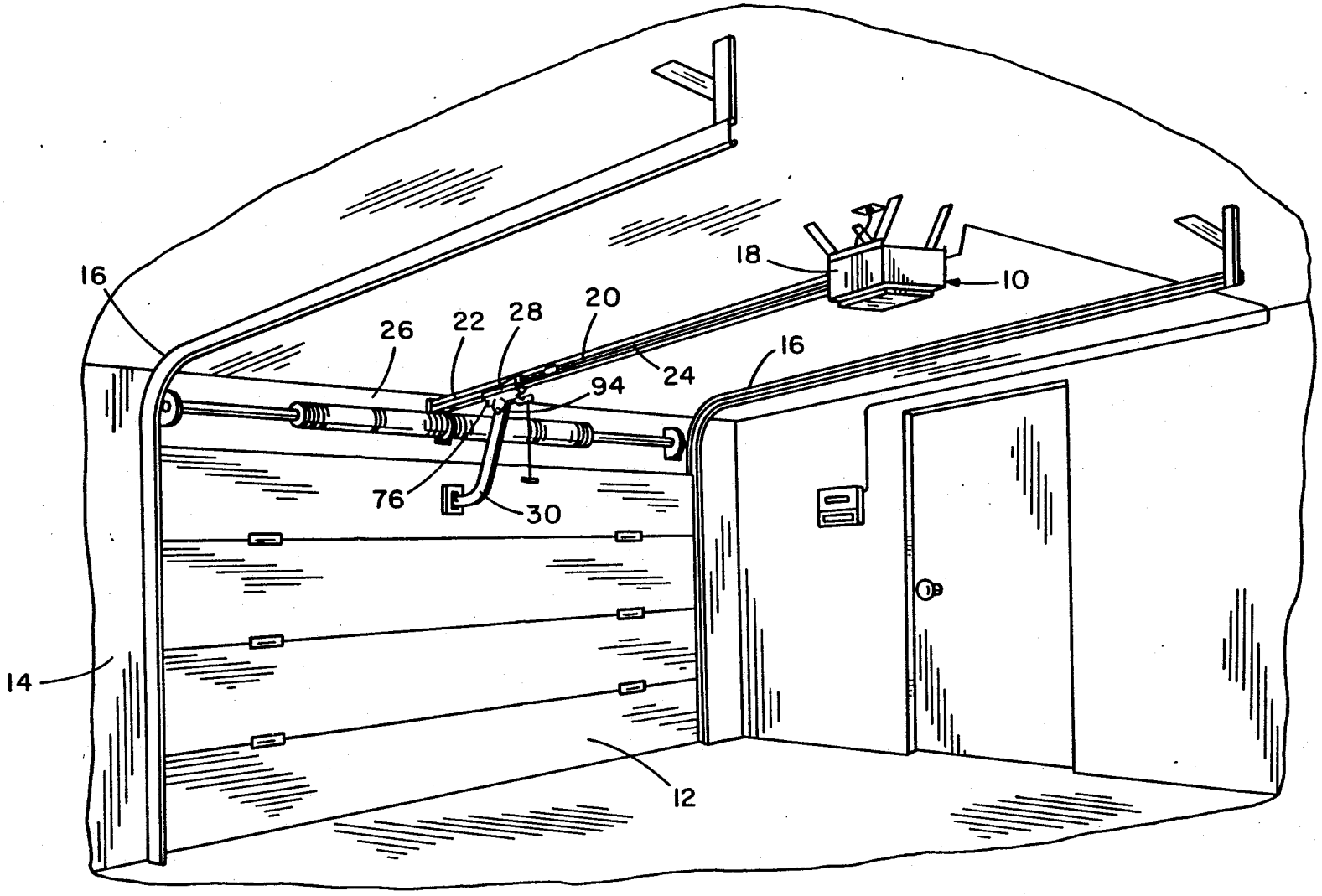
FIG. 1 is an isometric view of an interior of a garage showing details of a connection of a garage door opener to a sectional overhead door.
Figure 2:
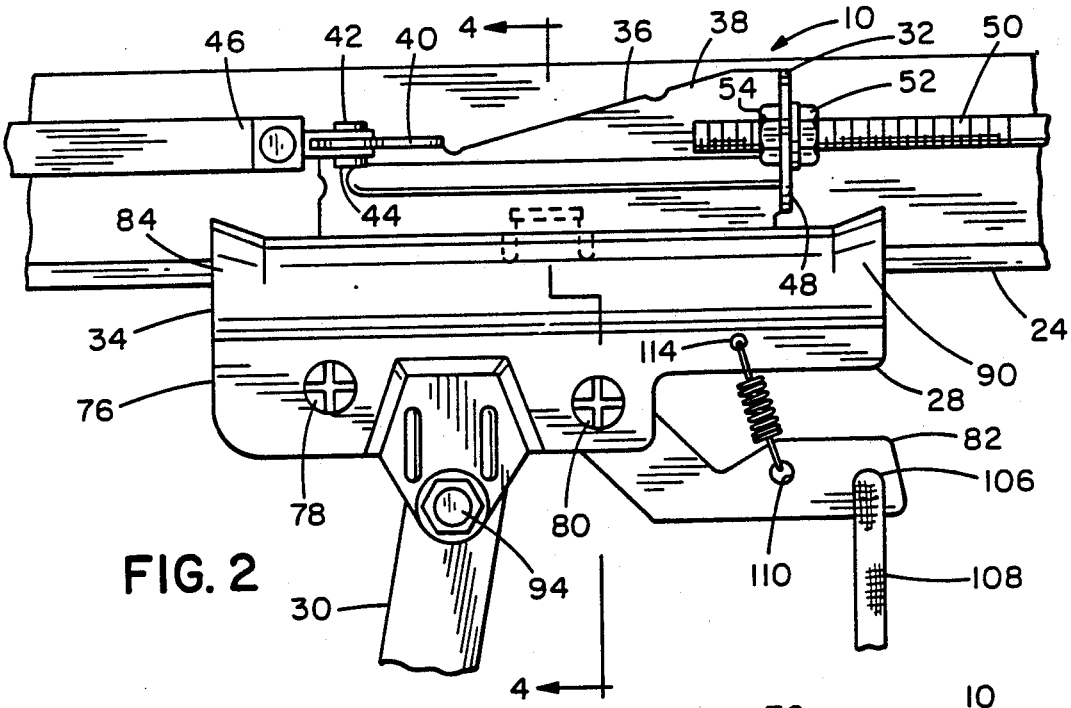
FIG. 2 is a side elevational view of a trolley of the garage door opener of FIG. 1, having portions broken away to show a latch arm in the engaged position.

Referring now to the drawings and especially to FIG. 1, a garage door opener system embodying various aspects of the present invention is generally identified by numeral 10. The garage door opener 10 is connected to a sectional overhead garage door 12 of a garage 14. The sectional overhead garage door 12 is mounted for travel on a pair of rails 16, as is conventional. The garage door opener 10 includes a drive unit 18 in driving connection with a full chain 20 and/or a chain 20/cable 22. The chain 20 and the cable 22 extend along a T-bar 24 running from the drive unit 18 to a forward portion 26 of the garage 14. A lock-out trolley 28 is connected to the chain 20 and the cable 22, to form an endless drive loop assembly, and the trolley is movable along the T-bar 24 by the chain 20 and the cable 22. An arm 30 is connected to the lock-out trolley 28 and to the sectional overhead garage door 12.

The lock-out trolley 28 includes an inner trolley member 32 connected to the chain 20 and the cable 22 to be driven thereby, and further includes an outer trolley member 34 adapted to be engaged and disengaged with the inner trolley 32. The lock-out trolley 28 provides selective mechanical coupling between the drive unit 18 and the garage door 12. The inner trolley 32 includes a drive connector bracket 36 having a side bracket 38 and a cable connector plate 40 formed integral with the side bracket 38 and extending outwardly therefrom. The cable fastener 46 is connected to the cable 22. The drive connector bracket 36 also includes a chain connector plate 48 formed integrally with the side bracket plate 38. The chain connector plate 48 is perforated and receives a threaded chain connector 50 held in place by a pair of nuts 52 and 54.

Figure 3:
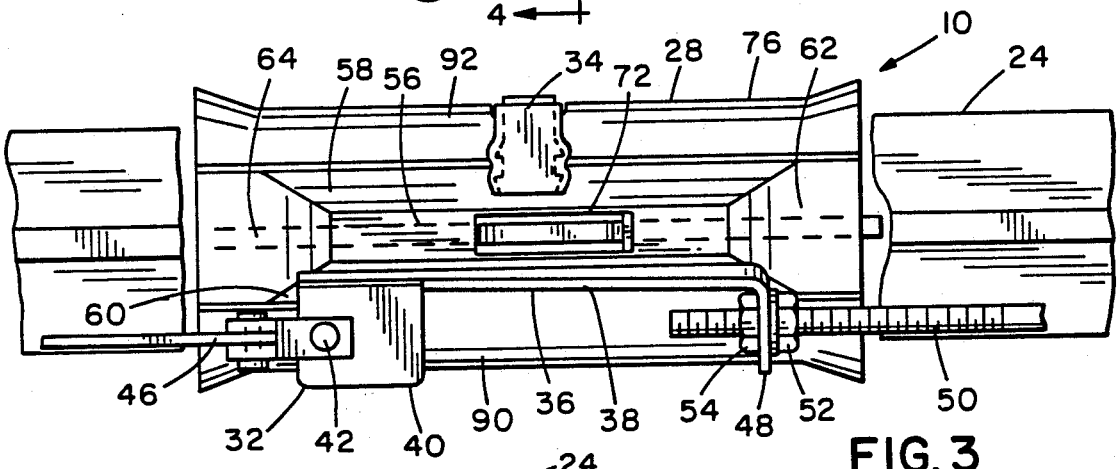
FIG. 3 is a plan view of the trolley of FIG. 2 showing the latch arm in a locked position.
Figure 4:
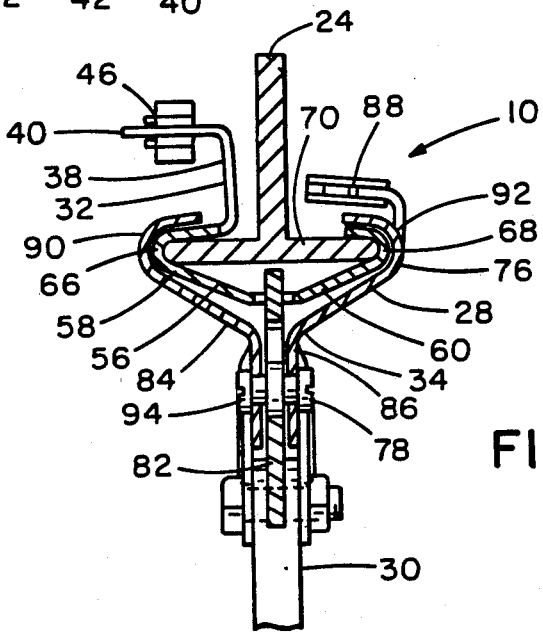
FIG. 4 is a sectional view taken substantially along line 4—4 of FIG. 2 and showing details of the interior of the trolley assembly.

The inner trolley 32 also includes a bottom portion 56 consisting, as may best be seen in FIG. 3, of a first chamferred side 58, a second chamferred side 60, the first chamferred end 62 and a second chamferred end 64. A curved lip 66 is formed integrally between the drive connector bracket 36 and the first chamferred side 58. A second curved lip 68 is connected between the second chamferred side 60 and an open space area. The lips 66 and 68 slidingly engage a horizontal portion 70 of the T-bar 24. When the drive unit 18 is activated, the chain 20 and the cable 22 move the inner trolley in either of two directions. However, if the drive unit 18 becomes disabled due to the electric power being interrupted or for any other reason, it may be necessary to disengage the outer trolley 34 from the inner trolley 32 to permit manual opening and closing of the garage door. Normally, the inner trolley 32, which has a trolley latch opening 72 formed therein, receives therein an engaging member connected to the outer trolley 34. If the engaging member is withdrawn, the inner 32 and outer trolley 34 are disengaged.

The outer trolley 34 includes a body 76, a first pin 78 connected to the body 76, a second pin 80 connected to the body 76 and a latch arm 82 mounted on the first and second pins 78 and 80 within the body 76. The body 76 consists of a pair of complementary body halves 84 and 86, which are substantially identical, with the exception of a bumper 88 formed integrally with the portion of the body half 86. The pins 78 and 80 connect the body halves 84 and 86 together with the latch arm 82 movably held between them. The body half 84 includes a curving section 90 which surrounds the lip 66 of the inner trolley 32. The body half 86 includes a curved portion 92, which surrounds the lip 68 of the inner trolley 34. The bumper 88 prevents the chain 20 from entering between the outer trolley 34 and the T-bar 24, which might cause jamming. A pivot 94 connects the arm 30 pivotally to the body halves 84 and 86 to draw the garage door 12 up and down.

The latch arm 82 includes an elongated opening 100 formed therein and a cardioid or heart-shaped opening 102 formed therein. The elongated opening 100 receives the first pin 78 while the cardioid opening 102 receives the second pin 80. The latch arm 82 also includes an extending trigger portion 104 having an aperture 106 formed therein to which a pull cord 108 is connected. A spring aperture 110, positioned adjacent the aperture 106, connects a tension spring 112 thereto. The tension spring 112 is also connected to the body half 84 by virtue of its reception in an aperture 114. The latch arm 82 includes a latching tongue or trolley engaging member 120 having a camming surface 122 formed therein and a pair of latching edges 124 and 126 adapted to engage the material defining the ends of the opening 72 of the inner trolley 32.

Figure 5:
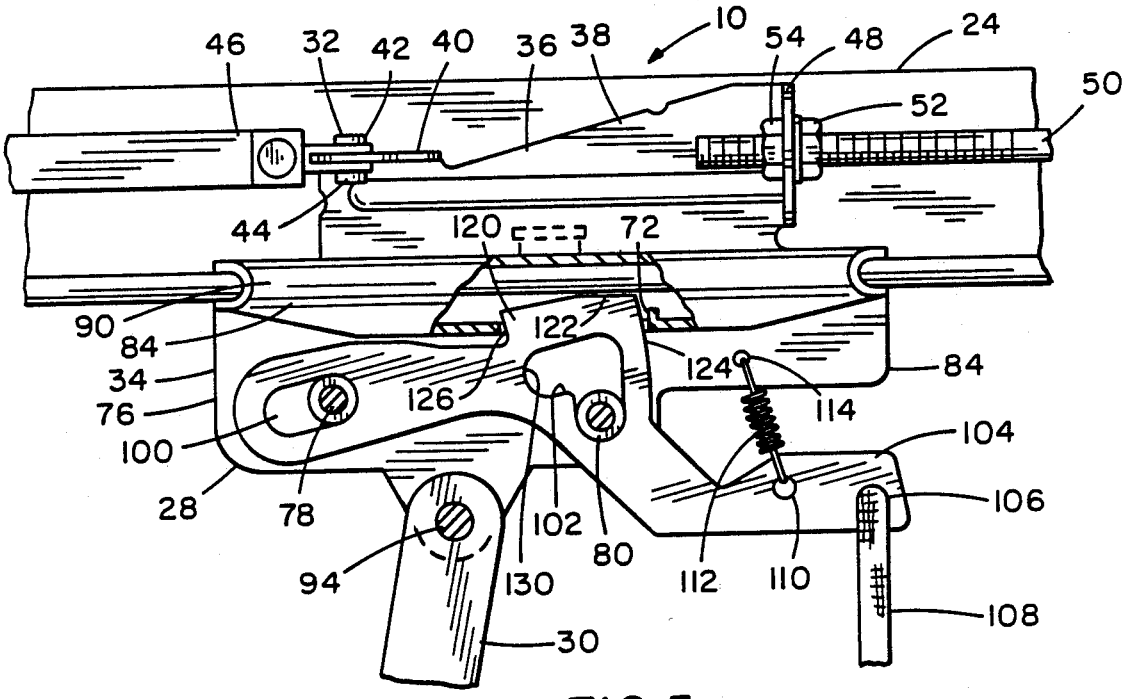
FIG. 5, which is similar to FIG. 2, has portions broken away to show details of a lock-out slot and the latch arm in a latched position.
Figure 6:
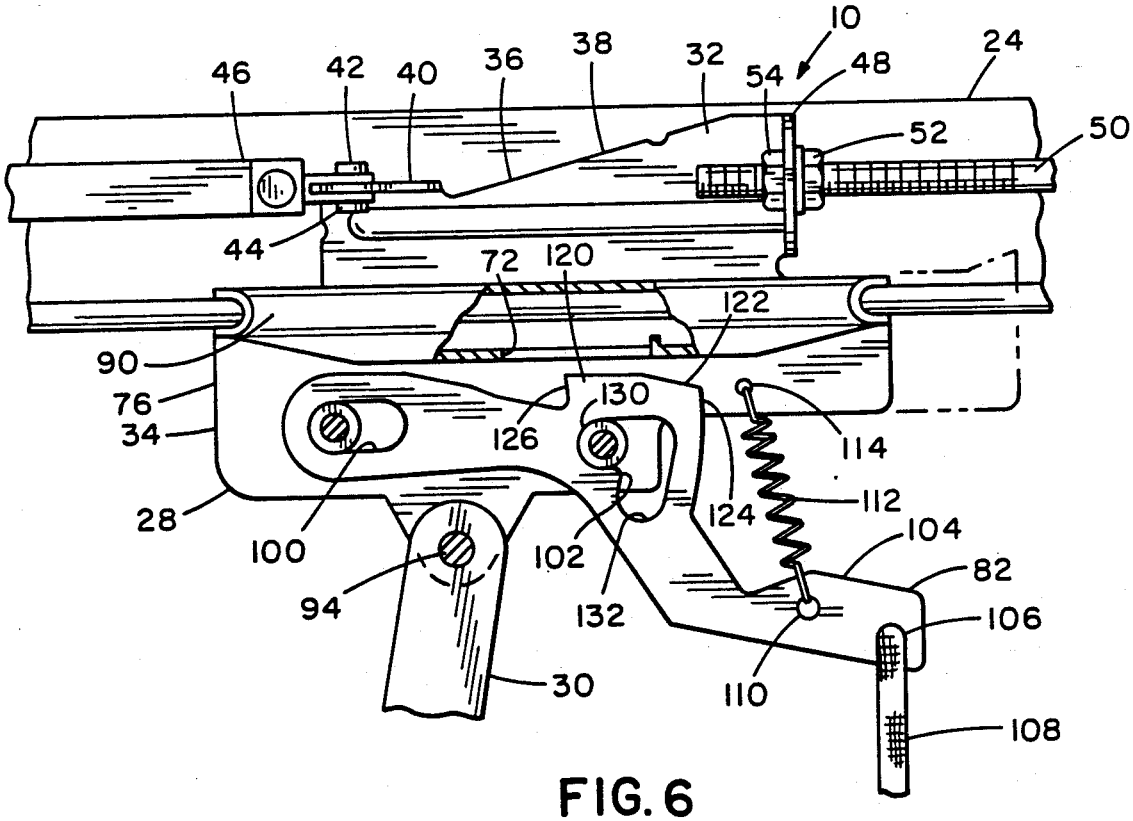
FIG. 6, which is similar to FIG. 5, illustrates the latch arm in a lock-out position.

As may best be seen in FIG. 5, with the latching arm in its engaged or up position the tongue 120 extends through the aperture 72 and holds the inner trolley 32 in driving engagement with the outer trolley 34. The latch arm 82 may be drawn down and pulled to the right, causing the slot 100 to translate with respect to the pin 78. This allows the pin 80 to enter an upper lobe 130 of the cardioid opening 102, locking the latch arm 82 out of contact with the inner trolley 32. If it is desired to allow the inner trolley 32 and the outer trolley 34 to be re-latched, the latch arm 82 is pulled down by the cord 108 and pulled slightly to the left, as the directions are shown in FIGS. 5 and 6, causing the latch arm 82 to translate or shift to the left and a lower lobe 132 of the cardioid opening 102 to be positioned adjacent the pin 80 allowing the latch arm 82 to rise under the bias of the spring 112. In the event that the inner trolley 32 and the outer trolley 34 are not in complete alignment, they may still be brought together since the camming surface 122 of the latch arm 82 may cam along the chamferred region 64 of the inner trolley until the aperture 72 is reached at which point the tongue 120 snaps into engagement with the aperture 72 where the inner trolley 32 and the outer trolley 34 remain engaged until it is desired to disengage the system again.

Thus, it may be appreciated that the lock-out trolley 28 of the instant invention provides an inner and outer trolley unit 28 having a pivoting and translating latch arm 82 which may be locked completely out of contact with the inner trolley 32, allowing the outer trolley 34 and the sectional overhead garage door 12 to be moved irrespective of the position of the inner trolley 32. In the event that it is desired to re-latch the inner and outer trolleys 32 and 34, the latch arm 82 may be released, allowing it to automatically cam into engagement with the aperture 72 when the inner trolley 32 and the outer trolley 34 are brought into engagement with each other.

While there has been illustrated and described a particular embodiment of the present invention, it will be appreciated that numerous changes and modifications will occur to those skilled in the art and it is intended in the appended claims to cover all those changes and modifications which fall within the true spirit and scope of the present invention.

What is claimed is:

1. A lock-out trolley for a garage door opener system, comprising:

a body;

a first pin connected to the body;

a second pin connected to the body;

a latch arm having a trolley engaging member for selectively engaging a trolley member, the latch arm having a pivot slot formed therein and having a lock-out aperture formed therein, the first pin engaging the pivot slot to allow the latch arm to translate and to rotate with respect to the body and the second pin engaging the lock-out aperture to allow the latch arm to assume a stable engaged position or a stable locked-out position; and means for biasing the lock-out aperture into engagement with the second pin.

2. A lock-out trolley for a garage door opener system as defined in claim 1, wherein the lock-out aperture has a first lobe and a second lobe, the second pin engaging the first lobe when the latch arm is in the engaged position, the second pin engaging the second lobe when the latch arm is in the locked-out position.

3. A lock-out trolley for a garage door opener system as defined in claim 2, wherein the lock-out aperture is cardioid shaped.

4. A lock-out trolley for a garage door opener system as defined in claims 1, 2 or 3, wherein the trolley engaging member comprises a tongue for engaging an engagement aperture in the trolley member.

5. A lock-out trolley for a garage door opener as defined in claim 4, wherein the tongue has a camming surface which slidably contacts the trolley member to displace the latch arm from its engaged position as the body and the trolley member are brought into registration.

6. A separable trolley assembly for use in a garage door operator system of the type including bar means along which is movable a drive assembly which is driven by a motor, and connecting structure having a first end attached to a garage door, said trolley assembly comprising:

an inner trolley member supported by and slidable along said bar means;

an outer trolley member supported by and slidable along said bar means, said outer trolley member receiving at least a portion of said inner trolley member when said trolley members are in an engagement position, one of said trolley members being connected to said drive assembly and the other of said trolley members being joined to the second end of said connecting structure; and a latch assembly movable between said engagement position wherein said latch assembly locks said trolley members together and a disengagement position wherein said latch assembly permits movement of said other trolley member independently of said one trolley member, said latch assembly including a latch arm having a first elongate slot and a second slot, said latch arm being held by a trolley member by a first pin extending through said first slot and by a second pin extending through said second slot, said arm being capable of rotational and translational movement with respect to said first slot, said second slot being nonlinear and including a first portion for holding said latch assembly in said disengagement position and further including a second portion permitting said latch assembly to shift to said engagement position, said latch assembly further comprising means for biasing said latch assembly toward said engagement position.

7. A trolley assembly as defined in claim 6, wherein said other trolley member and said a trolley member are said outer trolley member, and wherein said one trolley member is said inner trolley member.

8. A trolley assembly as defined in claim 6, wherein said second slot is heart-shaped, including an upper lobe comprising said first portion and a lower lobe comprising said second portion, said first slot being generally horizontally disposed and having a first end and a second end closer said second slot, the distance between said first slot first end and said upper lobe, as well as the distance between said first slot second end and said lower lobe, being substantially equal to the spacing between said first and second pins whereby shifting of said latch arm so that said second pin moves from said first lobe toward said second lobe causes said trolley members to be ready for engagement.

9. A trolley assembly as defined in claim 8, wherein said latch arm includes a triggering finger extending from adjacent said second slot away from said first slot, said means for biasing comprising an extension spring interconnecting said finger and the trolley member carrying said pins.

10. A latch arm for a lock-out trolley for a garage door opener system, comprising:

a trolley engaging member for selectively engaging a trolley member;

a pivot slot formed therein for engaging a first pin to allow the trolley engaging member arm to translate and to rotate with respect to the first pin; and a lock-out aperture formed therein for engaging a second pin to allow the trolley engaging member to assume a stable engaged position or a stable locked-out position.

11. A latch arm for a lock-out trolley for a garage door opener system as defined in claim 10, wherein the lock-out aperture comprises a cardioid shaped aperture having a first lobe for engaging said first pin to hold said trolley engaging member in said stable engaged position and a second lobe for engaging said second pin to hold said trolley engaging member in said stable locked-out position.

* * * * *